United States Patent [19]

Berkowitz

[11] 4,234,088

[45] Nov. 18, 1980

[54] FABRIC HANGER

[76] Inventor: Irving M. Berkowitz, 500 E. 85 St., New York, N.Y. 10028

[21] Appl. No.: 909,905

[22] Filed: May 26, 1978

[51] Int. Cl.[3] ..... B65D 85/66

[52] U.S. Cl. ..... 206/408; 248/174

[58] Field of Search ..... 206/408, 326, 279, 284, 206/289, 290, 291, 297; 211/45; 248/174; 190/13 B

[56] References Cited

U.S. PATENT DOCUMENTS

| | | | |
|---|---|---|---|
| 2,656,914 | 10/1953 | Gordon | 206/297 X |
| 2,685,962 | 8/1954 | Druth | 206/279 |
| 2,725,139 | 11/1955 | Fanning | 206/408 |
| 2,937,758 | 5/1960 | Tabb | 211/45 X |
| 3,029,051 | 4/1962 | Nichols | 248/174 X |
| 3,720,324 | 3/1973 | Berkowitz | 206/408 X |
| 3,844,499 | 10/1974 | Berkowitz | 206/408 |
| 3,965,583 | 6/1976 | Price | 211/45 X |
| 4,023,759 | 5/1977 | Perkins | 248/174 |

*Primary Examiner*—Stephen P. Garbe

*Attorney, Agent, or Firm*—Wolder, Gross & Yavner

[57] ABSTRACT

A hanger for carrying piece length fabric in a pendant, vertical roll includes a support assembly and a hanger assembly removably supported thereon. The support assembly includes a base portion and a substantially flat main body portion connected at one end thereof to the base portion so as to be supported in an upstanding position. The main body portion has longitudinally extending edges which form a core for supporting the roll of fabric. The hanger assembly is carried at an end of the main body portion opposite the base portion. The hanger assembly includes a longitudinally extending main support member with securing units carried at opposite longitudinal ends of the support member. The securing units may be of a variety of types with either single or double pointed members, and may include a stationary safety bar spaced from the pointed members. An attachment hook is carried by the hanger assembly for supporting the main support member in a generally horizontal position. Ties which extend through the fabric and a portion of the support assembly may also be used to securely hold the fabric on the support assembly during transport.

24 Claims, 17 Drawing Figures

III
III
25
26
20
21
27
29
30
31
32
33
34
35
36
37
38
38'
41
50
58

50
51
52
53
54
55
56
57
58
59
60
61
62
63
64
65
69
21
22
24
29
31
32
H
IX
VIII

FABRIC HANGER

BACKGROUND OF THE INVENTION

The present invention relates generally to hangers for fabric, and more particularly to such a hanger commonly used by fabric retailers for storing piece length fabrics in pendant, vertical roll form.

In applicant's prior U.S. Pat. Nos. 3,720,324 and 3,844,499 a hanger for supporting piece length fabrics in such pendant, vertical rolls is disclosed. The hanger shown and described in said prior patents was primarily concerned with the safety hazards of the prior art which included upwardly pointing pin members for securing fabric thereon and for providing a means to dispense with the need of reeling and unreeling the fabric onto and off an intermediate reel typically used for transportation. Accordingly, the hanger disclosed in applicant's prior issued patents included a longitudinally extending main member having two securing units connected at opposite longitudinal ends of the main member and each including at least one horizontal arm spaced beneath and extending transversely of the main member carried by a support extending downwardly from the adjacent end of the main member. Two upright, transversely spaced, pointed pins were secured to the arms and adapted to pierce and pass through the fabric to hold it on the arm. Additionally, a brace was required to be connected with the arm which would extend upwardly to the main member. A movable safety bar was provided so as to extend between the pins and rest on the pointed ends thereof during handling and shipment of the hanger. The safety bar had an opening for receiving the support to permit the safety bar to slide upwardly so as to expose the points when necessary for hanging the fabric on the pins and also had means for preventing rotation and vertical movement of the safety bar relative to the support so as to prevent inadvertent exposure of the pins.

Further, this prior device included a support for the hanger assembly consisting of a vertical shaft secured in a rectangularly shaped base with the main member of the hanger supported at the end of the vertical shaft opposite the base.

While the vertical shaft used in the prior device performed the function of preventing the pendant roll from collapsing within a shipping carton, it has been found inadequate to provide sufficient structural support for the roll and for the carton or container within which the hanger and roll are carried during transport so that handling and shipment of the rolled fabric when hung on the hanger was difficult.

It is accordingly a general object of the present invention to provide a fabric hanger for carrying piece length fabric in a pendant roll which is an improvement over the prior fabric hanger and which overcomes the disadvantages thereof.

A more specific object of the present invention is to provide a support assembly in such a hanger for carrying fabric which has a main body portion intended to prevent inward collapse of the rolled fabric so as to facilitate handling thereof for shipment and display.

Another object of the present invention is to provide a support assembly in a fabric hanger having a generally more rigid construction while being of a more simplified structure.

A further disadvantage of the prior device concerns the hanger assembly which is arranged to be carried on the support assembly. The structure of the hanger assembly in the prior device, including the provision of the sliding safety bar, was found to be excessively complicated resulting in difficult and expensive manufacturing techniques. The use of such a movable safety bar, while providing certain advantages, was found to be difficult to use and created certain problems when hanging fabric. Because of the movable safety bar, the main member required additional structural support. Further, the securing units at each end of the main member were formed of separate hook elements requiring alignment and assembly with the main member.

Accordingly, a further object of the present invention is to provide a fabric hanger in which the hanger assembly is of simplified construction avoiding the use of any moving parts so as to facilitate its manufacture and use.

SUMMARY OF THE INVENTION

The foregoing objects of the present invention are generally accomplished by providing a fabric hanger for carrying piece length fabric in a pendant roll which includes a support assembly and a hanger assembly removably supported thereon. The support assembly generally comprises a base portion and a substantially flat main body portion connected at one end thereof to the base portion and supported therefrom in an upstanding position. The main body portion has substantially longitudinally extending spaced apart edges forming a core for the roll of fabric to be hung on the hanger assembly. Means are provided at an end of the main body portion opposite the base portion for supporting the hanger assembly. Ties are preferably provided to extend through a selvedge of the fabric and a portion of the support assembly to secure the fabric to the support assembly.

While a variety of hanger assemblies which meet the criteria of the present invention may be carried by the support assembly, one embodiment thereof includes a longitudinally extending main support member, two securing units carried on the main support member at opposite longitudinal ends thereof with each of the securing units comprising an extension member depending from the main support member and two support arms connected at one end thereof to the extension member and extending in opposite directions therefrom. A substantially upwardly extending pointed member is carried at the other end of each of the support arms. A stationary safety bar to prevent injury from the pointed member extends transverse to the main support member and is spaced from the pointed members. An attachment means is also carried by the hanger assembly for supporting the main support member in generally horizontal disposition.

Other features, objects and advantages of the present invention will become more apparent from the detailed description of the invention in connection with the accompanying drawings described hereinbelow.

BRIEF DESCRIPTION OF THE DRAWINGS

The hanger for fabric made in accordance with the present invention is illustrated in the accompanying drawings in which.

DESCRIPTION OF THE INVENTION

Figure 4:
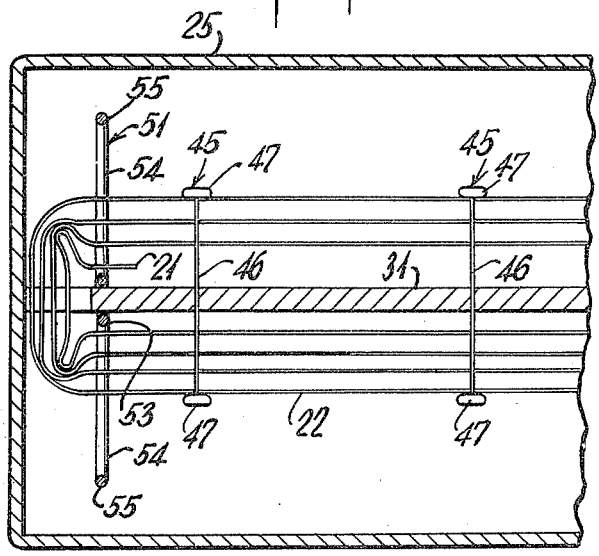
FIG. 4 is a sectional view taken along lines IV—IV of FIG. 3.
Figure 5:
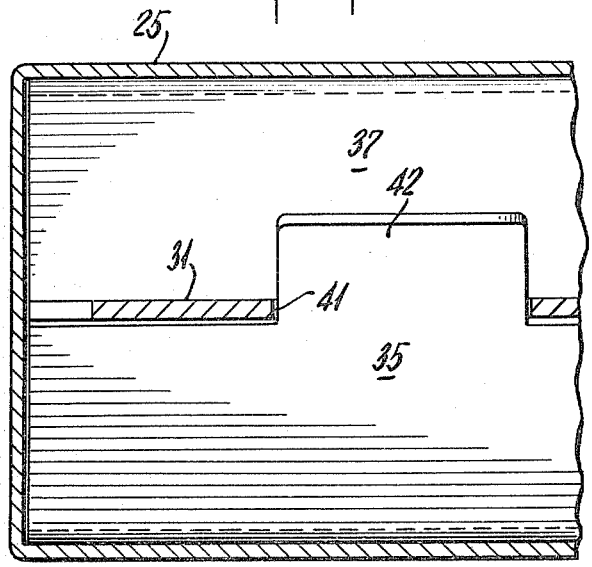
FIG. 5 is a sectional view taken along lines V—V of FIG. 3.
Figure 6:
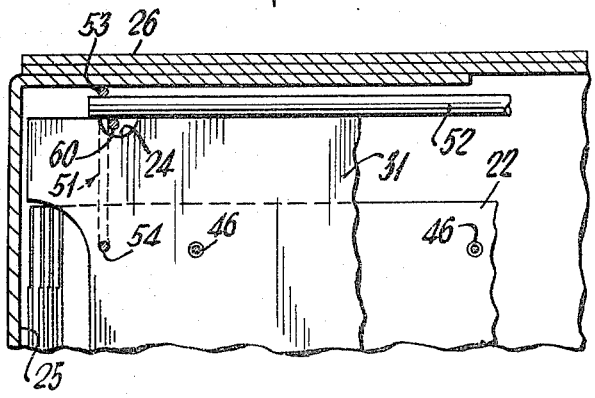
FIG. 6 is a sectional view taken along lines VI—VI of FIG. 3.
Figure 3:
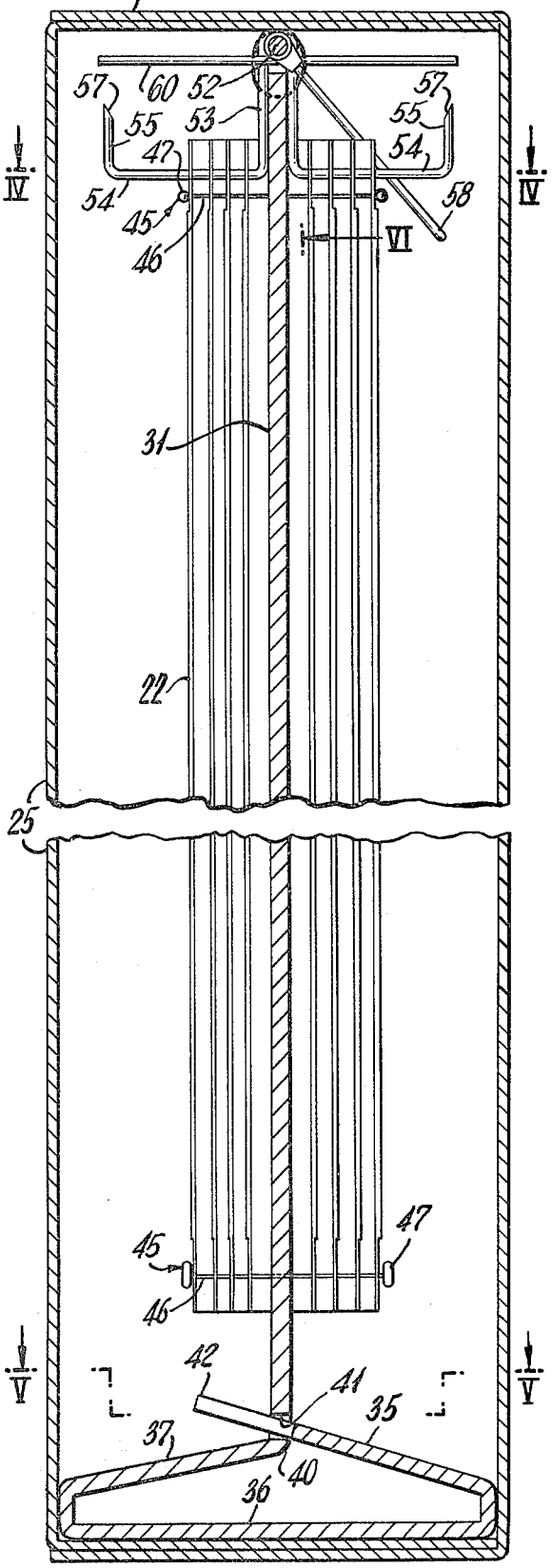
FIG. 3 is a sectional view taken along lines III—III of FIG. 1.

Referring now in more detail to the accompanying drawings, the hanger assembly 50 and support assembly 30, referred to collectively as the hanger 20, are intended to receive and support a piece length of fabric 21, as a hanging vertical roll. The various convolutions of the roll may be more fully appreciated from the sectional views of FIGS. 3 and 4, the roll therein being indicated as reference numeral 22. After the fabric 21 is hung on the hanger assembly 50 and wound about support assembly 30, the hanger 20 with the wound fabric may be placed in a carton 25 for shipment. The carton 25 may be of any suitable design and construction, and is preferably made of heavy cardboard with flaps 26 to allow opening for insertion and removal of the hanger 20 with wound fabric.

Figures 1, 2:
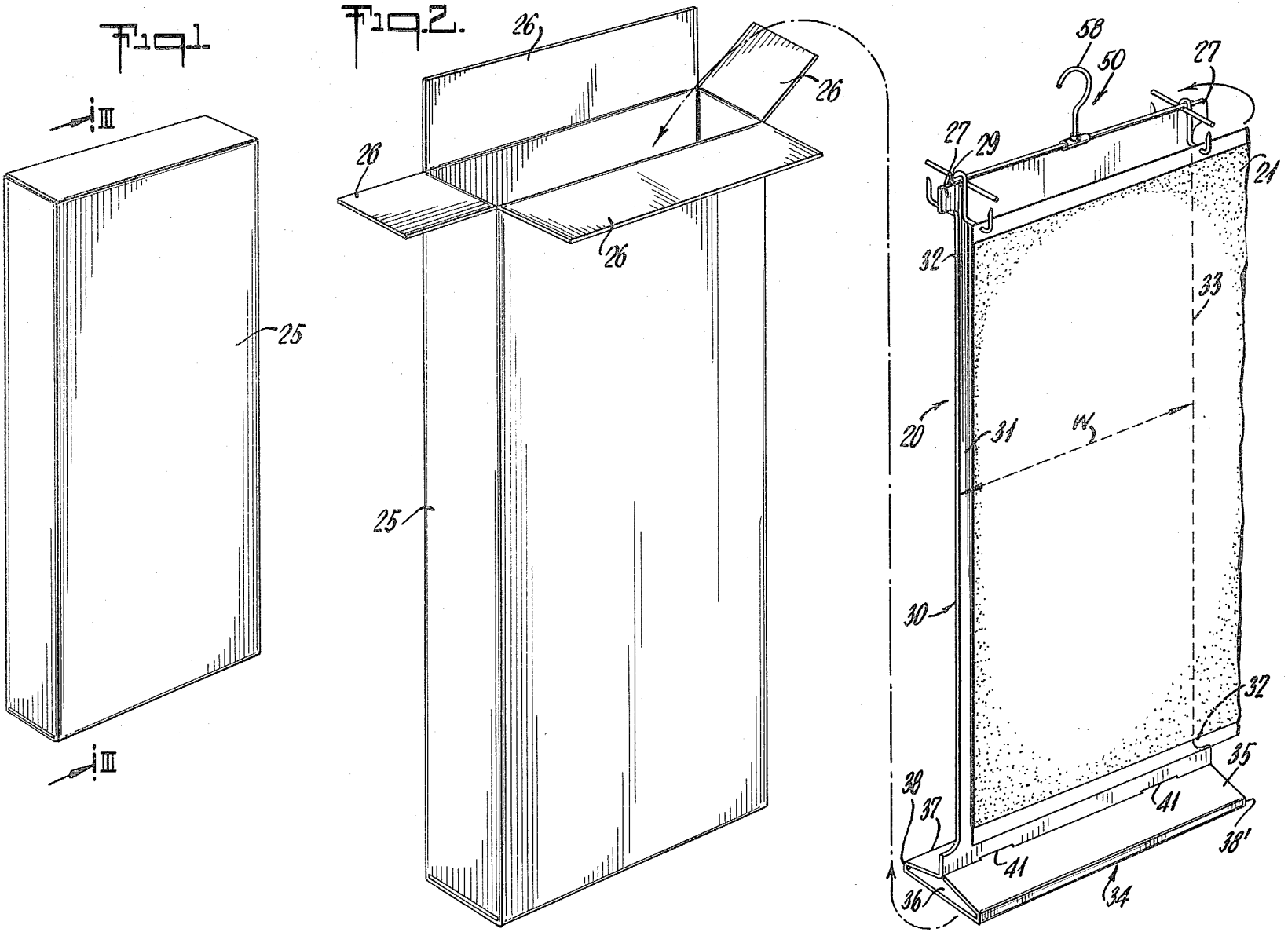
FIG. 1 is a perspective view showing a closed package or container for transport of the fabric carried on the hanger made in accordance with the present invention.
FIG. 2 is an exploded perspective view showing the container in an open condition and one embodiment of the hanger assembly with the support assembly of the present invention removed therefrom.

The support assembly, referred to generally as reference numeral 30, may be formed of a single piece of flat cardboard as illustrated in FIG. 2 having a width W generally corresponding to the desired minor axis of the roll of fabric. It has been found that a width W of approximately 16–18 inches provides the desired support and rigidity required for supporting the roll of fabric suitable for packaging in the shipping carton 25.

The support assembly 30 includes a main body portion 31, which is preferably provided with longitudinally extending cutouts 32 leaving tabs 27 and so as to form a core section having spaced apart edges 33 for supporting the innermost convolution of the fabric to be wound on the support assembly. The provision of the core section provides additional support to the entire roll once it is on the hanger assembly and wound on the support assembly. The support assembly 30 also includes a base portion 34 for supporting the main body portion 31 in vertical upstanding position. The base portion 34 includes two sloping sides 35 and 37 with a bottom 36 therebetween. A relatively short vertical side may be interposed between the sloping sides 35, 37 and the bottom 36.

The base portion 34 is formed integral with the main body portion 31 with sloping side 37 connected to the main body portion along a fold line or crease 40. In order to secure sloping side 35 with the other sloping side 37 to form a rigid base portion, one or more cutouts 41 are formed in the cardboard forming the support assembly along the fold line or crease 40. Tabs 42 are formed as extensions of the sloping side 35 so that they may be inserted into and through the slots 41 to complete the structure of the base portion 34.

It will be appreciated, that the base portion 34 and main body portion 31 may be formed from an integral sheet of approximately 18 inch wide cardboard having a straight horizontal edge 29 at one end thereof, cutout portions 32 along the longitudinal sides thereof, a first fold line or crease 40, a second fold line or crease 38, with sloping side 37 between fold lines 40 and 38, a third fold line or crease 38' with bottom 36 between fold lines 38 and 38' and the extensions 42.

Figure 16:
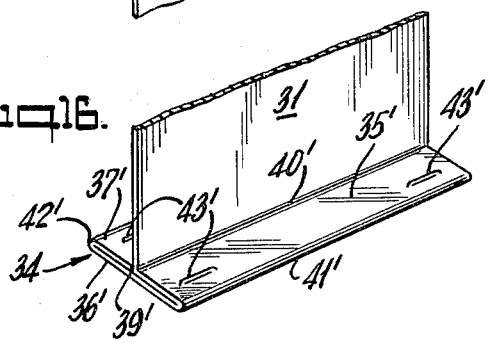
FIG. 16 is a perspective view showing another alternate base portion for the support assembly.

The base portion 34 may be alternatively formed as illustrated in FIG. 16. In the base portion 34 illustrated in FIG. 16, the main body portion 31 terminates at a first fold line 40'. A first flat section 35' is formed between fold line 40' and a second fold line 41'. A bottom portion 36' is formed between fold line 41' and a third fold line 42'. Finally, a third flat section 37' is formed between fold line 42' and a straight edge 39' forming the end of the cardboard. Flat sections 35' and 37' are secured to the flat bottom 36' by staples 43'. Accordingly, the base portion 34 of the support assembly is formed integrally with the main body portion 31, together forming a substantially T-shaped section.

Figure 12:
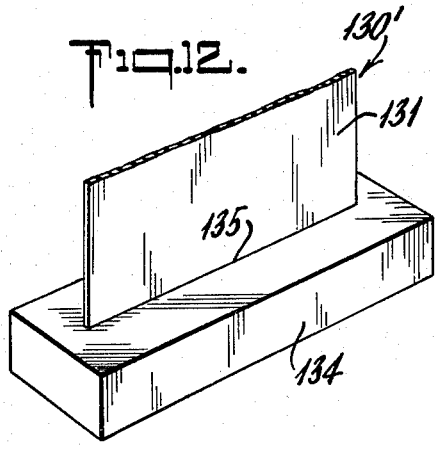
FIG. 12 is a partial perspective view showing an alternate base portion for the support assembly of the present invention.

An alternate support assembly 130 is illustrated in FIG. 12. In this arrangement base portion 134 is substantially box shaped to rigidly support main body portion 31 in a longitudinal cutout 135. No cutouts 32 are required, but as in the support assembly 30, spaced apart edges 133 are provided forming a core section to support the innermost convolution of the fabric.

The supporting assembly 30 or 130 with main body portion 31 or 131 carried upon base portion 34 or 134 provides the proper vertical spacing between the upper and lower ends of the fabric roll when carried within the carton 25 and further provides the required rigid support for the roll as it is being wound.

As with the surrounding assembly provided in applicant's prior above mentioned patents, the support assembly of the present invention prevents the fabric roll from falling with the hanger to the bottom of the carton where it would become crushed and creased.

A plurality of ties 45 consisting of either pins and fasteners, or more preferably plastic or flexible strips 46 with end stops 47, are passed through the upper and/or the lower selvedge of the fabric as well as through the main portion 31 of the support assembly for holding the fabric in secure position during transit.

After shipment to a retailer, the hanger assembly 50 with support assembly 30 and wound fabric 22 thereon may be removed from the carton and the hanger 20 supported on a hanger rod for display. If desired, the support assembly 30 may easily be removed from the hanger assembly by first removing the ties 45 from the upper selvedge and the lower selvedge of the fabric after which tabs 27 may be bent inwardly or broken away from the main body portion 31 and the entire support assembly vertically withdrawn in a downward direction away from the hanger assembly.

The hanger assembly 50 from which the fabric is hung, includes two identical securing units or support hooks 51 spaced apart in parallel relationship with each other and carried on a main support member or rod 52.

Figures 7, 8, 9, 10, 11:
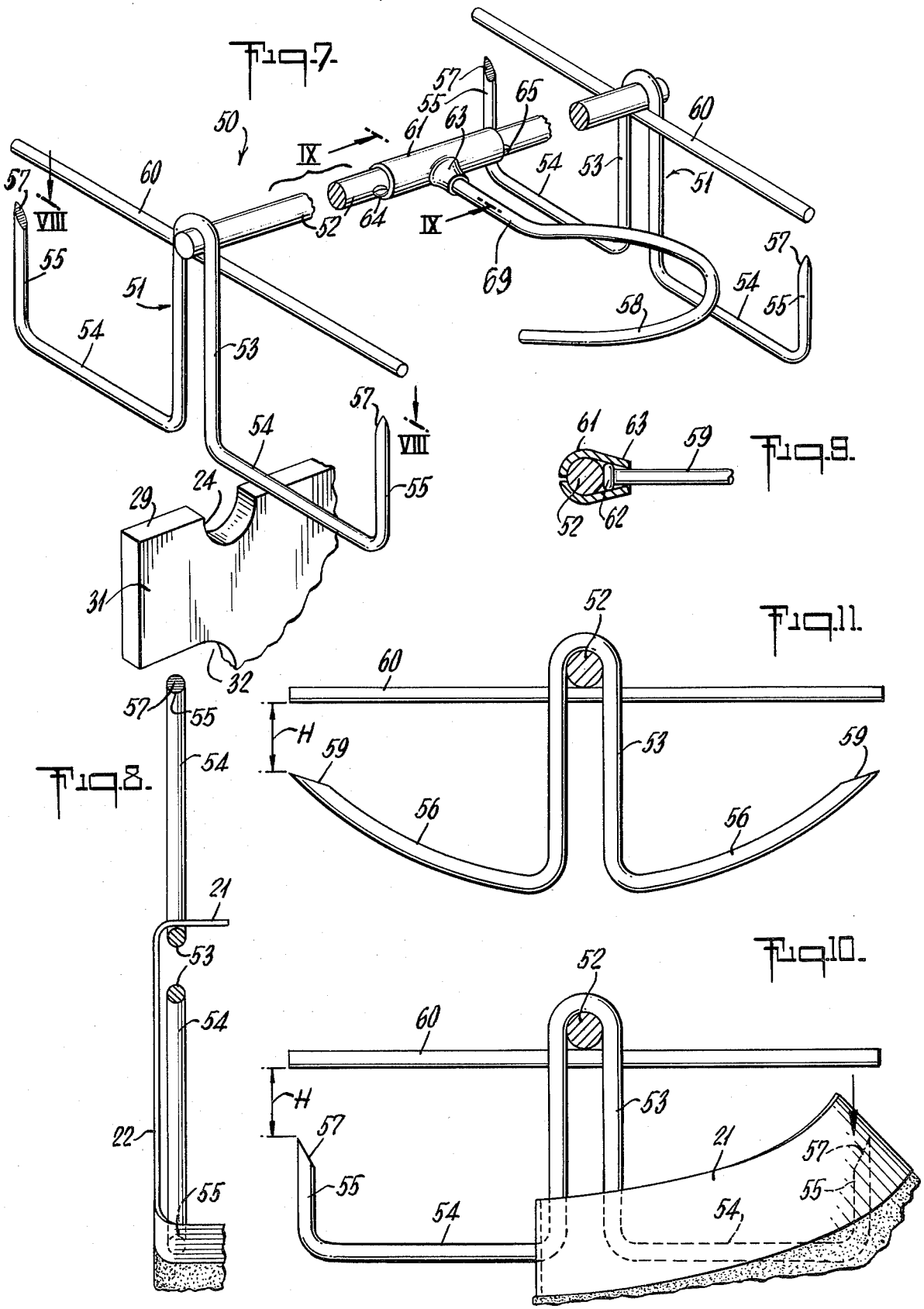
FIG. 7 is a perspective view showing the hanger assembly of the embodiment illustrated in FIG. 2 and a portion of the support assembly therefor in exploded relationship therewith.
FIG. 8 is a sectional view taken along lines VIII—VIII of FIG. 7.
FIG. 9 is a sectional view taken along lines IX—IX of FIG. 7.
FIG. 10 is an end view of the hanger assembly illustrated in FIG. 7 showing a portion thereof in accordance with one embodiment.
FIG. 11 is an end view similar to that of FIG. 10 showing a portion of the hanger assembly of FIG. 7 with a further embodiment thereof.

The support hooks 51 are secured to opposite ends of the support rod 52 thus forming a rigid hanger structure. Each of the support hooks may be formed by bending a single metal rod symmetrically about a centerline to form a U-shaped extension 53 depending from and preferably welded to support rod 52 with the closed end resting on rod 52. In the embodiment shown in FIGS. 2, 3,7 and 10, the securing units have upstanding vertical pins 55. These are carried on horizontally extending support arms 54 which are formed integrally with the U-shaped extension 53 by bending the legs thereof through 90 degrees on each side of the extension 53. The pins 55 are also integral with arms 54 and are formed by bending arms 54 through 90 degrees in the same direction as the first bend. Pins 55 terminate in pointed ends 57. In the embodiment of the support hooks shown in FIG. 11, the legs of the U-shaped section 53 are bent through an angle greater than 90 degrees so as to form curved arms 56 terminating in generally upwardly extending pointed ends 59. In both embodiments, the pointed ends 57 and 59 are created by cutting the rod at an angle to its longitudinal axis or by grinding the ends of the rod to form a conically shaped point.

Because of the possible hazards which would be created by leaving the pointed ends 57 or 59 fully exposed, a safety bar 60 is welded to the U-shaped section 53 and to the support rod 52 extended in a direction transverse to the longitudinal axis of both the support rod 52 and the extension 53, over a distance substantially equal to the distance between pointed ends 57 or 59. In this manner safety bar 60 will prevent accidental damage or injury which could otherwise be caused by exposed pointed ends. Spacing H between the ends of the hooks 57 or 59 and safety bar 60 is of sufficient distance to allow the fabric to be placed over the points of the hooks in order to pierce the fabric so that it may be held on the support arms 54 or 56 of the hooks.

The provision of the safety bar 60 also serves to make the entire structure of the hanger assembly 50 more rigid and secure. The provision of a safety bar 60 welded or otherwise secured to the support rod 52 and support hooks 51 also eliminates the need for movable safety rods which only tend to complicate and render the use of the hanger more difficult.

The attachment hook 58 is preferably formed of a metal rod having a shank 69 with base 62 carried within a conical housing 63 formed integral with a tubular support 61. In this manner, the hook 58 can be rotated about the support rod 52 so that it may be folded away from the vertical position into a substantial horizontal position in order to reduce the height of the package. Abutment stops 64 and 65 are provided on rod 52 to prevent substantial axial displacement of the tubular support 61 and hook 58.

Figure 15:
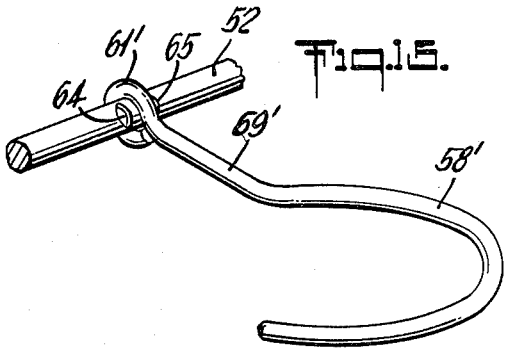
FIG. 15 is a perspective view of an alternate embodiment of a hook member used in the hanger assembly.

Attachment hook 58' could alternatively be formed as illustrated in FIG. 15. Shank 69' is provided with an eye 61' which surrounds support rod 52. Abutment stops would be placed closer together but otherwise perform the same function to limit horizontal movement of the hook. This structure would also permit the hook to fall below the horizontal to avoid any interference in closing a shipping carton.

Assembling the hanger assembly 50 with the support assembly 30 is facilitated by U-shaped section 53 which can be slid onto the main body section 31 of the support assembly. A cutout portion 24 is also preferably provided along the horizontal edge 29 of the support assembly in order to receive the safety bar 60 and thus allow the support rod 52 to lie flush against the horizontal edge 29 of the support assembly.

Figure 17:
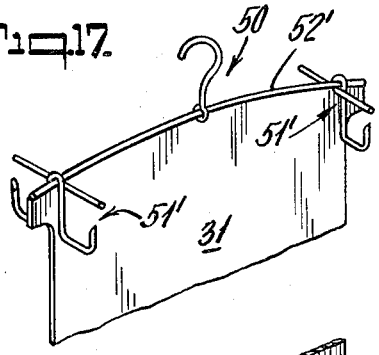
FIG. 17 is a perspective view showing an alternate embodiment for the hanger assembly.

FIG. 17 illustrates another embodiment of the hanger assembly. In this embodiment the hanger 50 is formed by a curved support rod 52' which carries support hooks 51' at its ends in a manner similar to that described above. In this embodiment the main body portion 31 of the support assembly has a curved upper edge to support the curved support rod 52' rather than the straight horizontal edge 29 described above.

Once the hanger assembly and support assembly are assembled the fabric may be attached thereto by spiking a selvedged edge of the piece length of fabric over the pointed ends 57 or 59 of the upstanding pins 55 or arms 56 respectively so that the pointed ends will pierce through the fabric. The fabric will be carried on the arms 54 or 56 so that the hanger will support the fabric in a pendant vertical roll.

Figure 13:
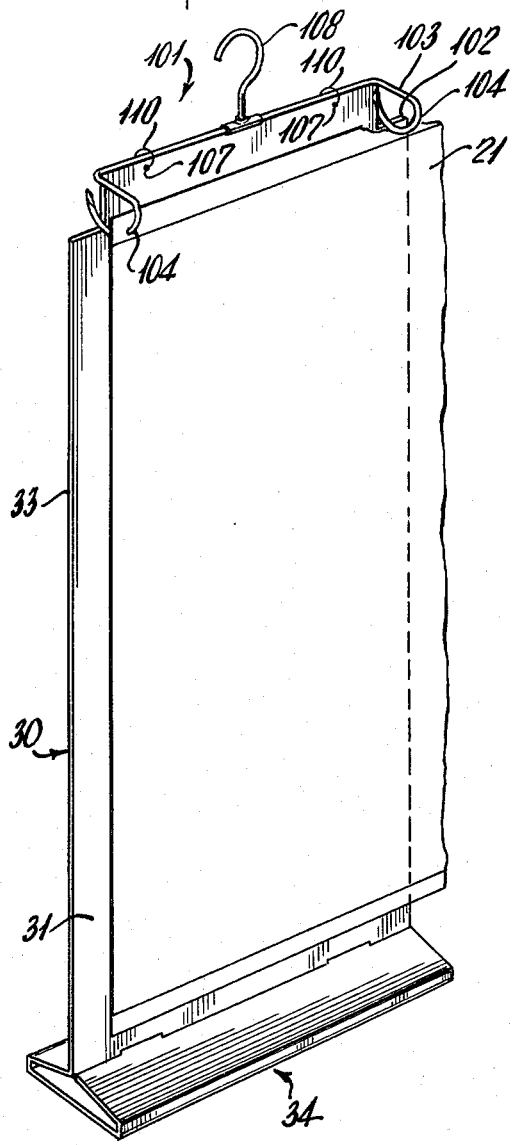
FIG. 13 is a perspective view showing a further embodiment of a hanger assembly with the support assembly.
Figure 14:
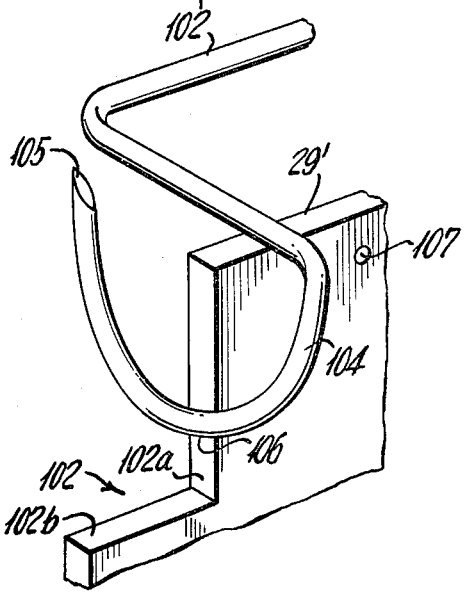
FIG. 14 is an enlarged exploded perspective view showing a portion of the hanger assembly of FIG. 13 and a portion of the support assembly thereof.

FIGS. 13 and 14 illustrate that hanger assemblies of a construction substantially different from the hanger assembly 50 hereinabove described, may be used in connection with the support assembly of the present invention to achieve the same results for supporting the fabric on the rigid support. In the embodiment illustrated in FIGS. 13 and 14, the support assembly 30 is substantially identical to that described in connection with FIGS. 2 through 11. A main body portion 31 is rigidly supported in an upright position on a base portion 34. It will of course be appreciated, that a main body portion 131 illustrated in FIG. 12 may be supported in a base portion 134 for use with the hanger assembly 101 illustrated in FIGS. 13 and 14. The spaced apart edges 33 provide the core section for supporting the fabric to be wound on the support assembly. In this embodiment, the upper end of the main body portion 31 is not provided with tabs 27 but rather has cutout corners 102 to receive the U-shaped support hooks 104 of the hanger assembly 101.

Hanger assembly 101 includes a main support member or rod 102 with extension arms 103 carried at opposite distal ends of the support rod 102 and which extend in a direction substantially transverse to the longitudinal axis of support rod 102. Substantially U-shaped fabric hanging support hooks 104 extend downwardly from the arms 103 and have pointed ends 105 onto which fabric is hung as it is wrapped about the support member 30. Pointed ends 105 are spaced relatively close to the longitudinal ends of support rod 102 so that rod 102 itself serves the function of a safety bar.

An attachment hook 108, substantially identical to attachment hook 58 previously described, is also provided on the support rod 102.

In the embodiment of FIGS. 13 and 14, support assembly 30 has a horizontal top edge 29' upon which the support rod 102 may be received. Cutouts 102 are formed by a vertical edge 102*a* and a horizontal edge 102*b*. The bottom 106 of U-shaped hooks 104 may conveniently rest upon horizontal edge 102*b*. A plurality of holes 107 may be provided along the top edge 29' to receive loops 110 for securing the hanger assembly 101 with the support assembly 30. Loops 110 may be formed either as flexible members or rigid clamps.

It should be understood from the foregoing that the support assembly of the present invention may be used with a variety of types of hanger assemblies for supporting the fabric in the desired manner.

While the invention has been described and illustrated with respect to certain preferred embodiments which produce satisfactory results, it will be understood by those skilled in the art, after understanding the purpose of the invention, that various other changes and modifications may be made without departing from the spirit and scope of the invention.

What is claimed is:

1. A fabric hanger for carrying piece length fabric in a pendant roll comprising a support assembly and a hanger assembly removably supported thereon, said hanger assembly having a center point;

said support assembly comprising a base portion, a substantially flat main body portion connected at one end thereof to said base portion and supported therefrom in an upstanding position, said main body portion having substantially longitudinally extending spaced apart edges forming a core for said roll of fabric and said edges being disposed opposite to each other a substantial distance from said hanger assembly center point means at an end of said main body portion opposite said base portion for removably supporting said hanger assembly;

said hanger assembly comprising a main support member, and means carried by said main support member from which fabric may be hung;

attachment means carried by said hanger assembly for supporting said main support member in generally horizontal disposition; and anchoring means releaseably securing a selvedge of the fabric carried on said support assembly proximate the base portion of said support assembly.

2. The fabric hanger according to claim 1 wherein said anchoring means comprises at least one tie extending through said selvedge of said fabric and a portion of said support assembly.

3. The fabric hanger according to claim 2 wherein said tie is straight and rigid.

4. The fabric hanger according to claim 2 wherein said tie is flexible.

5. The fabric hanger according to claim 1 wherein said main support member is substantially straight and wherein said main body portion of said support assembly has a substantially flat upper edge for supporting said hanger assembly thereon so that said main support member lies substantially flush therewith.

6. The fabric hanger according to claim 1 wherein said main support member is substantially curved and wherein said main body portion of said support assembly has a substantially curved upper edge for supporting said hanger assembly thereon so that said main support member lies substantially flush therewith.

7. The fabric hanger according to claim 1 wherein said main body portion of said support assembly is formed integrally with said base portion and is connected thereto along a first fold line, said base portion comprising a bottom and two sloping sides, one of said sloping sides being connected with said main body portion along said first fold line.

8. The fabric hanger according to claim 7 wherein said sloping sides are connected with said bottom along second and third fold lines, said other sloping side being connected with said main body portion by fastening means carried along an edge thereof.

9. The fabric hanger according to claim 1 wherein said main body portion of said support assembly is formed integrally with said base portion and is connected thereto along a first fold line, said base portion comprising a bottom and two flat portions, one of said flat portions being connected with said main body portion along said first fold line and being connected with said bottom along a second fold line, said second flat portion being connected with said flat bottom along a third fold line, and a plurality of staples securing said flat portions with said bottom portion.

10. The fabric hanger according to claim 1 further comprising tabs integrally formed with said main body portion at the end thereof for removably supporting said hanger assembly.

11. The fabric hanger according to claim 1 further comprising cutouts on opposite sides of said main body portion at the end thereof for removably supporting said hanger assembly to receive said hanger assembly.

12. The fabric hanger according to claim 1 wherein said base portion is substantially box shaped, and wherein said main body portion is supported in a longitudinally extending groove in said base portion.

13. The fabric hanger according to claim 1 wherein said means from which fabric may be hung comprises two securing units carried on said main support member at opposite longitudinal ends thereof, each of said securing units comprising an extension member depending from said main support member, two support arms connected at one end thereof to said extension member each extending in opposite directions therefrom, a substantially upwardly extending pointed member at the other end of each of said support arms, and a stationary support bar extending transverse to said main support member and spaced from said pointed members.

14. The fabric hanger according to claim 13 wherein said extension member of each of said securing units comprises a substantially U-shaped element the open end of which extends downwardly and away from said main support member, each of said support arms being formed integrally with said U-shaped element and extending away therefrom for supporting thereon said fabric.

15. The fabric hanger according to claim 14 wherein said main support member is substantially straight and wherein said U-shaped elements are secured to said straight support member at the closed end thereof.

16. The fabric hanger according to claim 15 wherein said safety bar comprises a substantially straight rod secured to said straight main support and secured to said U-shaped extends so that the longitudinal axis of said safety bar is oriented in a direction perpendicular to the longitudinal axis of both said U-shaped element and said main support member.

17. The fabric hanger according to claim 14 wherein said support arms formed integrally with said U-shaped element extend in a direction substantially perpendicular to the longitudinal axis of said U-shaped element for supporting thereon said fabric and further comprising upstanding vertical pins formed integrally with said support arms at an end thereof opposite said U-shaped element having a longitudinal axis substantially parallel with the longitudinal axis of said U-shaped element, said upwardly extending pointed members being carried at an end of said pins opposite the end thereof connected to said arms.

18. The fabric hanger according to claim 17 wherein said pointed members are formed by a conical surface.

19. The fabric hanger according to claim 17 wherein each of said pointed members has a flat surface extending at an angle to the longitudinal axis of said pins.

20. The fabric hanger according to claim 14 wherein each of said support arms formed integrally with said U-shaped elements comprise substantially curved members extending away from said U-shaped element, said pointed members carried at the ends thereof extending in a direction substantially toward the closed end of said U-shaped elements, each of said pointed members having a flat surface formed as a section of said support arms.

21. The fabric hanger according to claim 1 wherein said attachment means comprises a support hook having a shank member connected to the substantial mid-point of said main support member for pivotal movement about the longitudinal axis thereof.

22. The fabric hanger according to claim 1 wherein said means from which fabric may be hung comprises two securing units carried on said main support member at opposite longitudinal ends thereof, each said securing unit comprising an extension arm extending in a direction substantially transverse to the longitudinal axis of said main support member, and a substantially U-shaped member connected from one leg thereof to said extension arm, the distal end of the other leg thereof having a pointed end for receiving said fabric.

23. A fabric hanger for carrying piece length fabric comprising a support assembly and a hanger assembly removably supported on said support assembly, said hanger assembly having a center point, said hanger assembly comprising a longitudinally extending support rod, two support hooks secured to opposite longitudinal ends of said support rod, each of said support hooks comprising a substantially U-shaped extension member having a closed end connected to said support rod and an open end extending downwardly and away therefrom, a support arm formed integrally with each leg of said U-shaped extension member at the open end thereof and extending in opposite directions, a substantially upwardly extending pointed member carried at the end of each of said support arms for piercing the fabric to be supported on said arms, and a stationary safety bar secured to said U-shaped extension member extending in a direction transverse to the longitudinal axis of said main support member and having ends spaced from said pointed members, said support assembly including a base and a vertically upstanding member supported on said base at one end thereof for removably carrying said hanger assembly at the other end thereof is fixed spaced relation with said base, said upstanding member being substantially flat and having substantially longitudinally extending spaced apart edges disposed opposite to each other a substantial distance from said hanger assembly center point an anchoring means releasably securing a selvedge of the fabric carried on said support assembly proximate the base of said support assembly.

24. The fabric hanger according to claim 23 wherein said vertical upstanding member of said support assembly is formed integrally with said base along a fold line.

* * * * *